US010625917B2

(12) United States Patent
Stelzer et al.

(10) Patent No.: US 10,625,917 B2
(45) Date of Patent: Apr. 21, 2020

(54) VACUUM PANEL FOR NON-ROUND CONTAINERS

(71) Applicant: Amcor Rigid Plastics USA, LLC, Wilmington, DE (US)

(72) Inventors: James Stelzer, South Lyon, MI (US); Rohit V. Joshi, Alpharetta, GA (US); Guizhang Zheng, Ann Arbor, MI (US); Dwayne Gannon, Tecumseh, MI (US)

(73) Assignee: AMCOR RIGID PLASTICS USA, LLC, Wilmington, DE (US)

( * ) Notice: Subject to any disclaimer, the term of this patent is extended or adjusted under 35 U.S.C. 154(b) by 151 days.

(21) Appl. No.: 15/520,018

(22) PCT Filed: Oct. 23, 2014

(86) PCT No.: PCT/US2014/061894
§ 371 (c)(1),
(2) Date: Apr. 18, 2017

(87) PCT Pub. No.: WO2016/064392
PCT Pub. Date: Apr. 28, 2016

(65) Prior Publication Data

US 2017/0349349 A1 Dec. 7, 2017

(51) Int. Cl.

| | |
|---|---|
| ***B65D 79/00*** | (2006.01) |
| ***B65D 1/40*** | (2006.01) |
| ***B65D 1/02*** | (2006.01) |

(52) U.S. Cl.
CPC ..... *B65D 79/005* (2013.01); *B65D 1/0223* (2013.01); *B65D 1/0246* (2013.01); *B65D 1/0276* (2013.01); *B65D 1/40* (2013.01); *B65D 2501/0036* (2013.01); *B65D 2501/0081* (2013.01)

(58) Field of Classification Search
CPC .. B65D 1/0223; B65D 1/0246; B65D 1/0276; B65D 1/40; B65D 2501/0036; B65D 2501/0081; B65D 79/005
USPC ..... 220/675
See application file for complete search history.

(56) References Cited

U.S. PATENT DOCUMENTS

| | | | | |
|---|---|---|---|---|
| 5,341,946 | A | 8/1994 | Vailliencourt et al. | |
| 8,556,097 | B2 * | 10/2013 | Mast | B65D 1/0223 215/384 |
| 8,651,307 | B2 | 2/2014 | Deemer et al. | |
| 2001/0054597 | A1 * | 12/2001 | Ozawa | B65D 1/0223 215/381 |

(Continued)

OTHER PUBLICATIONS

International Search Report and Written Opinion for PCT/US2014/061894, dated Jul. 15, 2015; ISA/KR.

(Continued)

*Primary Examiner* — Fenn C Mathew
*Assistant Examiner* — Madison L Poos
(74) *Attorney, Agent, or Firm* — Harness, Dickey & Pierce, P.L.C.

(57) ABSTRACT

A non-round container including a sidewall with an outer surface. A first vacuum panel is recessed beneath the outer surface and includes at least one first rib. A second vacuum panel is recessed beneath the outer surface and includes at least one second rib. A middle vacuum panel is recessed beneath the outer surface and is positioned between the first and the second vacuum panels. The middle vacuum panel includes at least one middle rib.

28 Claims, 6 Drawing Sheets

(56) References Cited

U.S. PATENT DOCUMENTS

| | | | | |
|---|---|---|---|---|
| 2004/0022976 | A1* | 2/2004 | Kato | B29C 49/18 428/35.7 |
| 2004/0144747 | A1 | 7/2004 | Saito et al. | |
| 2005/0067369 | A1 | 3/2005 | Trude | |
| 2005/0269284 | A1 | 12/2005 | Pedmo et al. | |
| 2008/0105645 | A1 | 5/2008 | Boukobza | |
| 2009/0057263 | A1 | 3/2009 | Barker et al. | |
| 2009/0321385 | A1 | 12/2009 | Oguchi et al. | |
| 2010/0155360 | A1 | 6/2010 | Mast et al. | |
| 2010/0301003 | A1 | 12/2010 | Lewis et al. | |
| 2011/0220668 | A1 | 9/2011 | Steih et al. | |
| 2012/0097635 | A1 | 4/2012 | Yourist et al. | |
| 2012/0219738 | A1* | 8/2012 | Boukobza | B65D 1/0223 428/35.7 |
| 2013/0082024 | A1 | 4/2013 | Howell et al. | |
| 2013/0228249 | A1 | 9/2013 | Gill | |
| 2014/0138343 | A1 | 5/2014 | Joshi et al. | |
| 2015/0108081 | A1 | 4/2015 | Boulay et al. | |

OTHER PUBLICATIONS

International Search Report and Written Opinion for PCT/US2015/025940, dated Jul. 24, 2015; ISA/KR.

* cited by examiner

VACUUM PANEL FOR NON-ROUND CONTAINERS

CROSS-REFERENCE TO RELATED APPLICATION

This application is a U.S. National Phase Application under 35 U.S.C. 371 of International Application No. PCT/US2014/061894 filed on Oct. 23, 2014 and published as WO 2016/064392 A1 on Apr. 28, 2016. The entire disclosure of the above application is incorporated herein by reference.

FIELD

The present disclosure relates to non-round containers having vacuum panels.

BACKGROUND

This section provides background information related to the present disclosure, and is not necessarily prior art.

As a result of environmental and other concerns, plastic containers, more specifically polyester and even more specifically polyethylene terephthalate (PET) containers, are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where $\rho$ is the density of the PET material; $\rho_a$ is the density of pure amorphous PET material (1.333 g/cc); and $\rho_c$ is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching an injection molded PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is cloudy or opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately one (1) to five (5) seconds. Manufacturers of PET juice bottles, which must be hot-filled at approximately 190° F. (88° C.), currently use heat setting to produce PET bottles having an overall crystallinity in the range of approximately 25%-35%.

While current containers are suitable for their intended use, they are subject to improvement. For example, a non-round container having the following properties would be desirable: when hot filled and under pressure, the container is able to resist expansion and deformation; and when under vacuum, the container is able to absorb vacuum and resist container skewing to help the container remain square.

SUMMARY

This section provides a general summary of the disclosure, and is not a comprehensive disclosure of its full scope or all of its features.

The present teachings provide for a non-round container. The container includes a sidewall having an outer surface. A first vacuum panel is recessed beneath the outer surface and includes at least one first rib. A second vacuum panel is recessed beneath the outer surface and includes at least one second rib. A middle vacuum panel is recessed beneath the outer surface and is positioned between the first and the second vacuum panels. The middle vacuum panel includes at least one middle rib.

The present teachings further provide for a non-round container including a plurality of sidewalls. Each sidewall includes an outer surface, a first vacuum panel, a second vacuum panel, and a middle vacuum panel. The first vacuum panel is recessed beneath the outer surface and includes a plurality of first ribs. The second vacuum panel is recessed beneath the outer surface and includes a plurality of second ribs. The middle vacuum panel is recessed beneath the outer surface and is positioned between the first and the second vacuum panels. The middle vacuum panel includes a middle rib configured as an initiator to permit the first, the second, and the middle vacuum panels to flex inward when the non-round container is under vacuum. The middle vacuum panel is connected to both the first vacuum panel and the second vacuum panel. The first and the second vacuum panels are both larger than the middle vacuum panel.

The present teachings also provide for a non-round container including a plurality of sidewalls. Each sidewall includes an outer surface, an upper vacuum panel, a lower vacuum panel, and a middle vacuum panel. The upper vacuum panel is recessed beneath the outer surface and includes a plurality of upper ribs. The lower vacuum panel is recessed beneath the outer surface and includes a plurality of lower ribs. The middle vacuum panel is recessed beneath the outer surface and is positioned between the upper and the lower vacuum panels. The middle vacuum panel includes a middle rib configured as an initiator to permit the sidewalls to flex inward when the non-round container is under vacuum. The middle vacuum panel is devoid of ribs other than the middle rib. The upper and the lower vacuum panels are both larger than the middle vacuum panel. The middle vacuum panel is connected to both the upper vacuum panel and the lower vacuum panel. Each one of the upper and the lower vacuum panels are recessed further beneath the outer surface than the middle vacuum panel. Each one of the upper, lower, and middle vacuum panels have a height extending parallel to a longitudinal axis of the container. The plurality of upper ribs, the plurality of lower ribs, and the middle rib extend in a lengthwise direction perpendicular to the longitudinal axis of the container.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
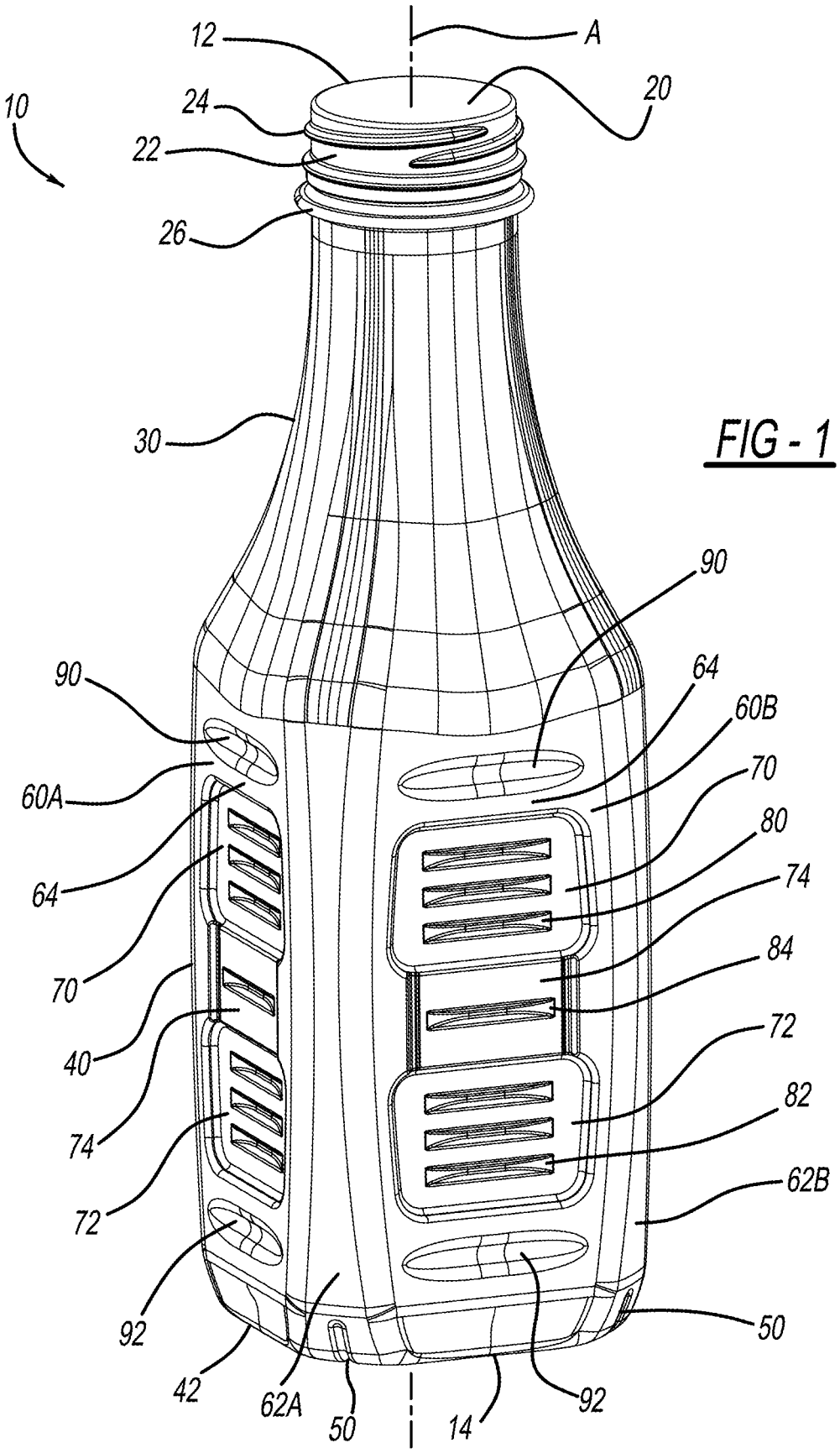
FIG. 1 is a perspective view of a container according to the present teachings.
Figure 2:
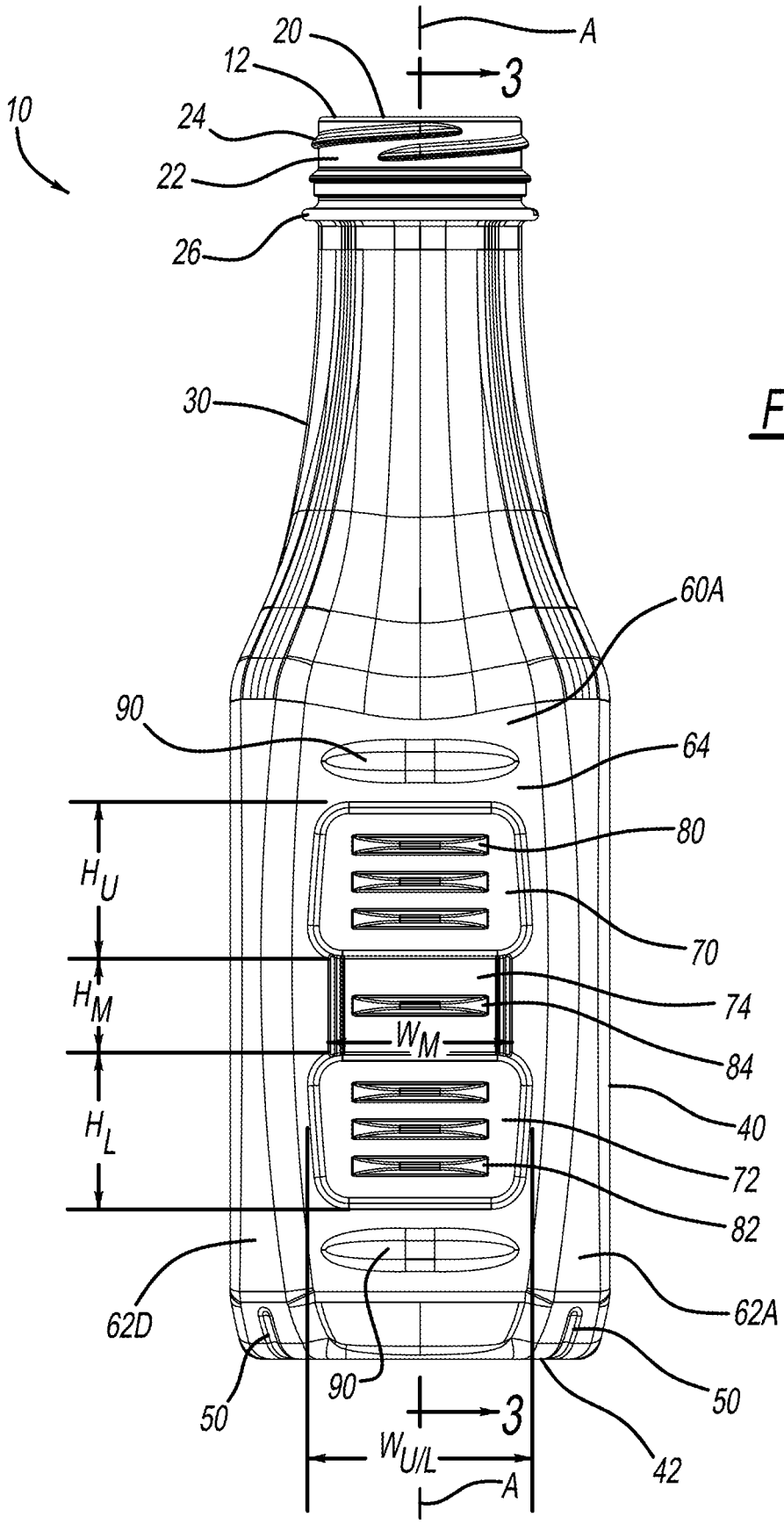
FIG. 2 is a side view of the container of FIG. 1.

With initial reference to FIGS. 1 and 2, a container according to the present teachings is illustrated at reference numeral 10. The container 10 can be any suitable non-round container of any suitable shape or size. For example, the container 10 can be substantially rectangular or substantially square, as illustrated. The container 10 can also, for example, be triangular, pentagonal, hexagonal, octagonal, or polygonal, which may have different dimensions and volume capacities. Other modifications can be made to the container 10 depending on the specific application and environmental requirements.

The container 10 can be a hot-filled container made from any suitable material, such as any suitable blow-molded thermoplastic, including PET, LDPE, HDPE, PP, TS, and the like. The container 10 can be of any suitable size, such as 18.5 ounces, and can be configured to be hot-filled with any suitable commodity, such as water, tea, or juice.

The commodity may be in any form, such as a solid or semi-solid product. In one example, a commodity may be introduced into the container 10 during a thermal process, typically a hot-fill process. For hot-fill bottling applications, bottlers generally fill the container 10 with a product at an elevated temperature between approximately 155° F. to 205° F. (approximately 68° C. to 96° C.) and seal the container 10 with a closure (not illustrated) before cooling. In addition, the container 10 may be suitable for other high-temperature pasteurization or retort filling processes or other thermal processes as well. In another example, the commodity may be introduced into the container 10 under ambient temperatures.

The container 10 can be a blow molded, biaxially oriented container with a unitary construction from a single or multi-layer material. A well-known stretch-molding, heat-setting process for making the container 10 generally involves the manufacture of a preform (not shown) of a polyester material, such as polyethylene terephthalate (PET), having a shape well known to those skilled in the art similar to a test-tube with a generally cylindrical cross section.

A preform version of container 10 includes a support ring 26, which may be used to carry or orient the preform through and at various stages of manufacture. For example, the preform may be carried by the support ring 26, the support ring 26 may be used to aid in positioning the preform in a mold cavity, or the support ring 26 may be used to carry an intermediate container once molded. At the outset, the preform may be placed into the mold cavity such that the support ring 26 is captured at an upper end of the mold cavity. In general, the mold cavity has an interior surface corresponding to a desired outer profile of the container 10.

In one example, a machine (not illustrated) places the preform heated to a temperature between approximately 190° F. to 250° F. (approximately 88° C. to 121° C.) into the mold cavity. The mold cavity may be heated to a temperature between approximately 250° F. to 350° F. (approximately 121° C. to 177° C.). A stretch rod apparatus (not illustrated) stretches or extends the heated preform within the mold cavity to a length approximately that of the intermediate container thereby molecularly orienting the polyester material in an axial direction generally corresponding with the central longitudinal axis of the container 10. While the stretch rod extends the preform, air having a pressure between 300 PSI to 600 PSI (2.07 MPa to 4.14 MPa) assists in extending the preform in the axial direction and in expanding the preform in a circumferential or hoop direction thereby substantially conforming the polyester material to the shape of the mold cavity and further molecularly orienting the polyester material in a direction generally perpendicular to the axial direction, thus establishing the biaxial molecular orientation of the polyester material in most of the intermediate container. The pressurized air holds the mostly biaxial molecularly oriented polyester material against the mold cavity for a period of approximately one (1) to five (5) seconds before removal of the intermediate container from the mold cavity. This process is known as heat setting and results in the container 10 being suitable for filling with a product at high temperatures.

Other manufacturing methods may be suitable for manufacturing the container 10. For example, extrusion blow molding, one step injection stretch blow molding, and injection blow molding, using other conventional materials including, for example, high density polyethylene, polypropylene, polyethylene naphthalate (PEN), a PET/PEN blend or copolymer, and various multilayer structures may be suitable for manufacturing the container 10. Those having ordinary skill in the art will readily know and understand plastic container manufacturing method alternatives.

The container 10 generally includes a first end 12 and a second end 14, which is opposite to the first end 12. A longitudinal axis A of the container 10 extends between the first end 12 and the second end 14 through an axial center of the container 10. At the first end 12, an opening 20 is generally defined by a finish 22 of the container 10. Extending from an outer periphery of the finish 22 are threads 24, which are configured to cooperate with corresponding threads of any suitable closure in order to close the opening 20, and thus close the container 10. Extending from an outer periphery of the container 10 proximate to the finish 22, or at the finish 22, is the support ring 26. The support ring 26 can be used to couple with a blow molding machine for blow molding the container 10 from a preform, for example, as explained above.

Extending from the finish 22 is a neck 30 of the container 10. The neck 30 generally and gradually slopes outward and away from the longitudinal axis A as the neck 30 extends down and away from the finish 22 towards the second end 14 of the container 10. The neck 30 extends to a body 40 of the container 10. The body 40 extends from the neck 30 to a base 42 of the container 10 at the second end 14 of the container 10.

Figure 3:
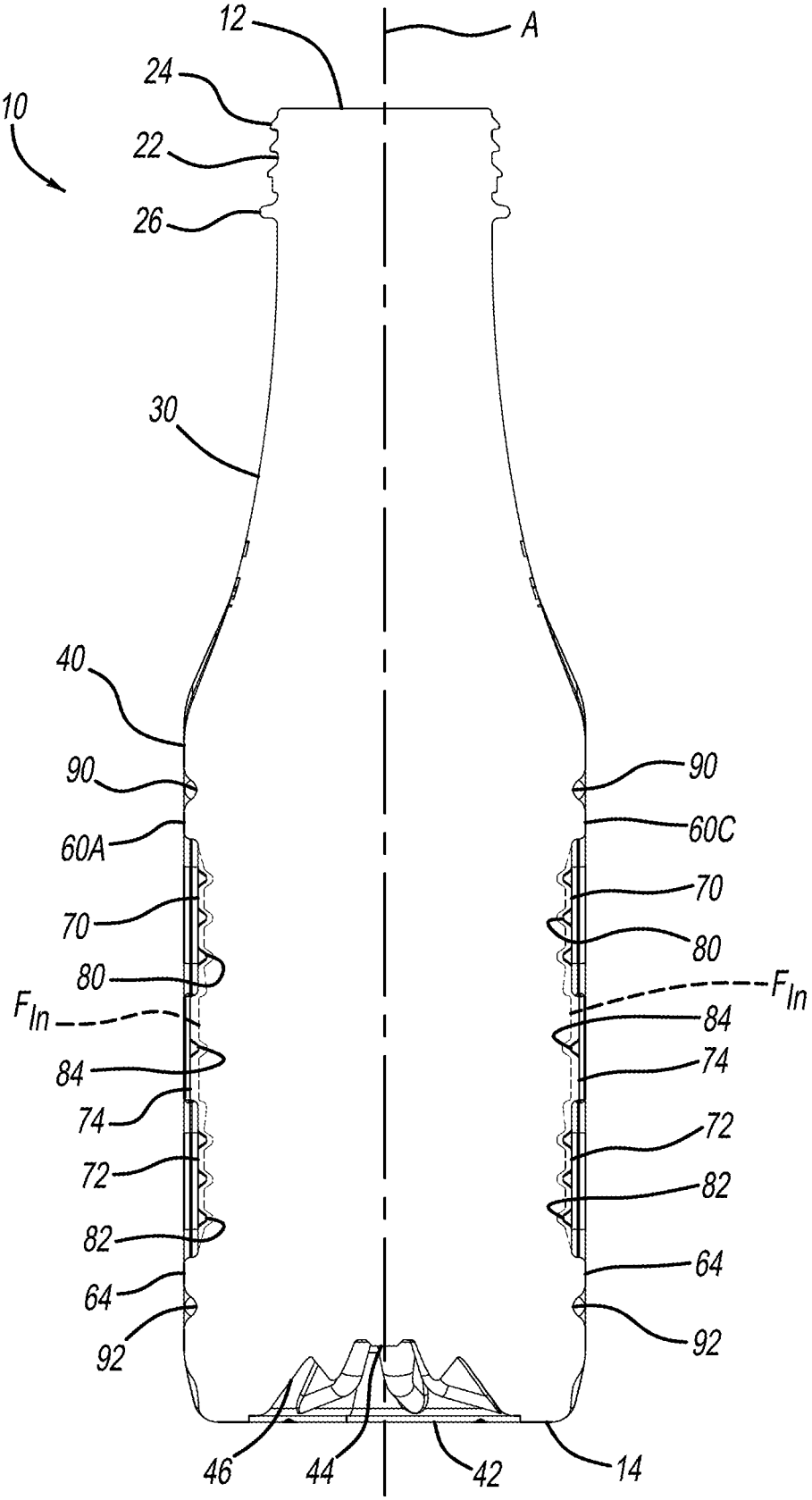
FIG. 3 is a cross-sectional view of the container taken along line 3-3 of FIG. 2.
Figure 4:
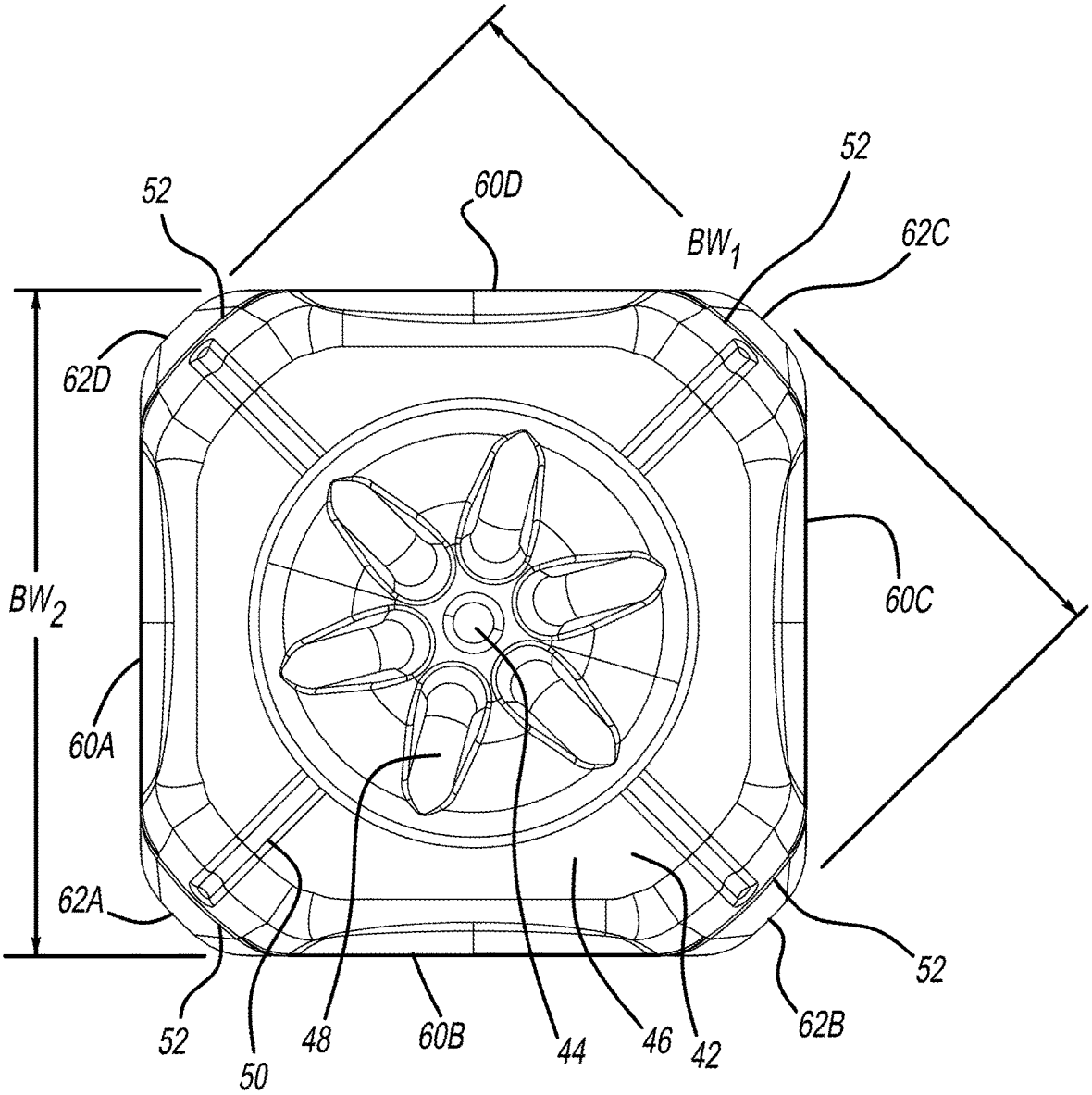
FIG. 4 is a bottom view of the container.
Figure 5:
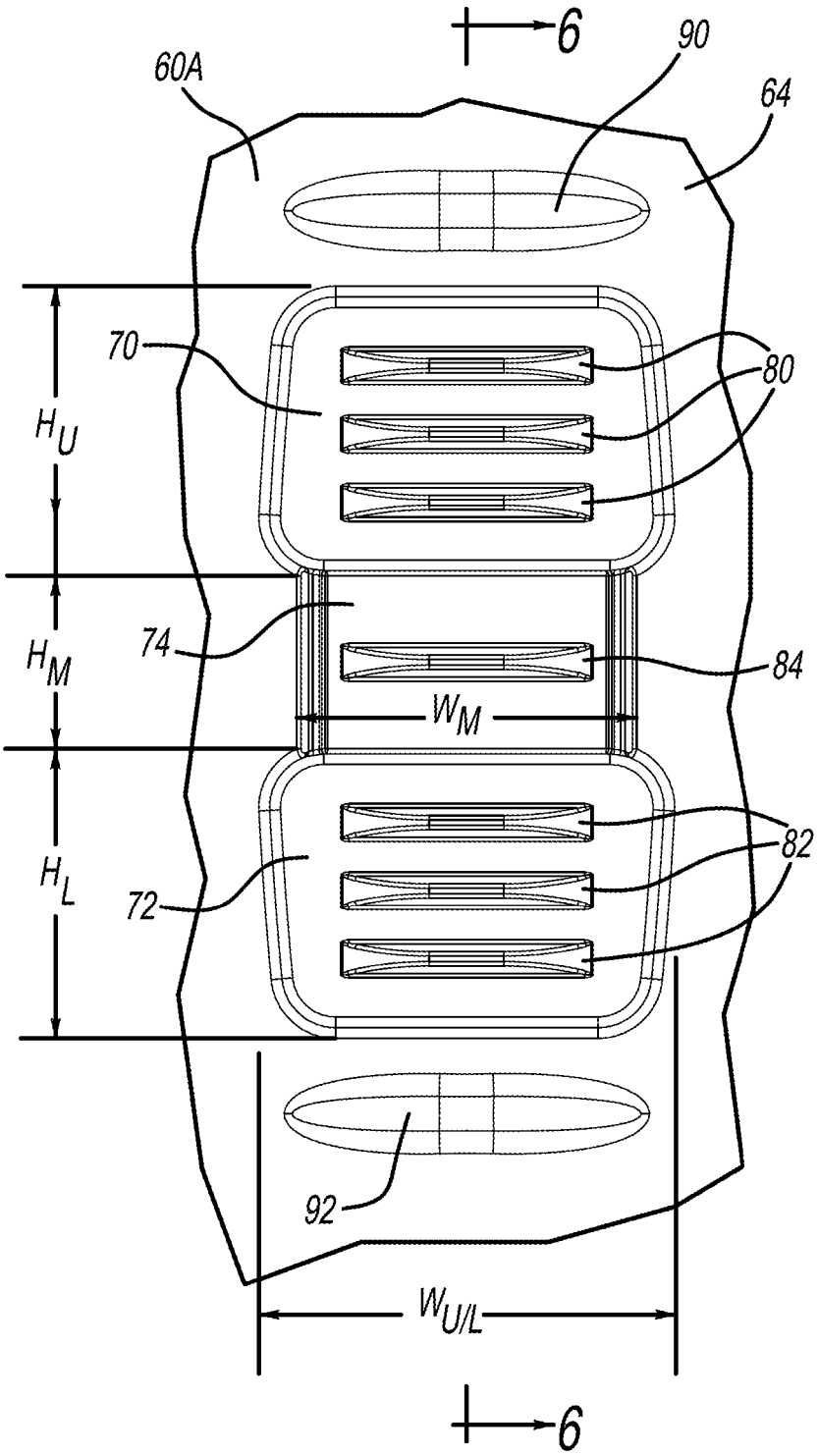
FIG. 5 is a close-up view of side panels of a sidewall of the container.
Figure 6:
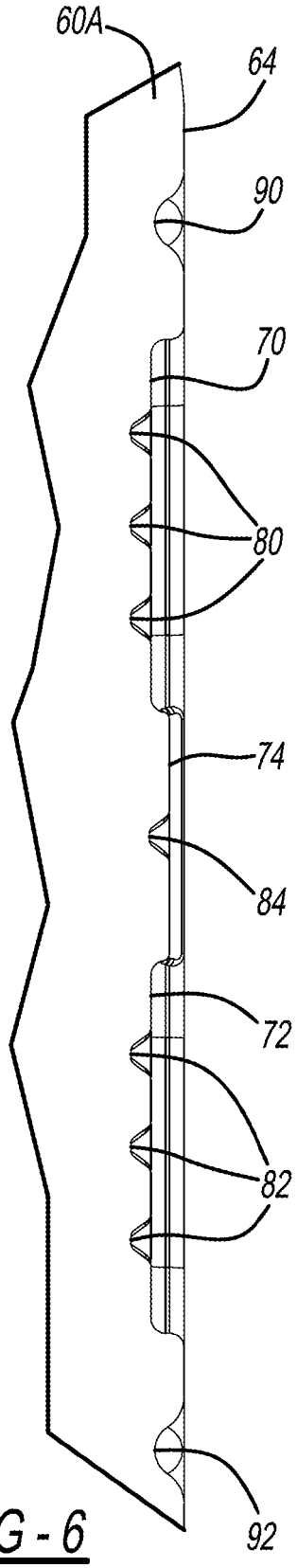
FIG. 6 is a cross-sectional view taken along line 6-6 of FIG. 5.

With additional reference to FIGS. 3 and 4, the base 42 will now be described. The base 42 generally includes a central push-up portion 44. The longitudinal axis A extends through a center of the central push-up portion 44. Surrounding the central push-up portion 44, and extending radially outward therefrom, is a diaphragm 46. The base 42 can include any suitable strengthening features, such as center ribs 48. The center ribs 48 are spaced apart and generally extend outward from the central push-up portion 44. Outer ribs 50 may also be included. The outer ribs 50 generally extend across the diaphragm 46 to, or proximate to, corners 52 of the base 42. The outer ribs 50 can extend beyond the corners 52 to chamfered edges 62A-62D, as illustrated in FIGS. 1 and 2 for example. Each one of the center ribs 48 and the outer ribs 50 may be recessed within the base 42.

The central push-up portion 44 and the diaphragm 46 of the base 42 are configured to move towards and away from the first end 12 to help the container 10 maintain its overall shape as the container 10 is hot-filled and subsequently cools. For example, when the container 10 is hot-filled and under pressure, the central push-up portion 44 and the diaphragm 46 are configured to move along the longitudinal axis A away from the first end 12. When the container 10 cools and is under vacuum, the central push-up portion 44 and the diaphragm 46 are configured to move back towards the first end 12, such as to a position closer to the first end 12 as compared to an as-blown position.

The body 40 of the container 10 can include any suitable number of sidewalls. For example and as illustrated, the body 40 can include a first sidewall 60A, a second sidewall 60B, a third sidewall 60C, and a fourth sidewall 60D. Between each sidewall 60A-60D is one of a plurality of chamfered edges 62A-62D. For example and as illustrated in FIG. 4, between the first sidewall 60A and the second sidewall 60B is a first chamfered edge 62A. Between the second sidewall 60B and the third sidewall 60C is a second chamfered edge 62B. Between the third sidewall 60C and the fourth sidewall 60D is a third chamfered edge 62C. Between the fourth sidewall 60D and the first sidewall 60A is a fourth chamfered edge 62D. The chamfered edges 62A-62D can connect the sidewalls 60A-60D that each chamfered edge 62A-62D is between.

With reference to FIGS. 1-3, 5, and 6 for example, each one of the sidewalls 60A-60D includes an outer surface 64. Recessed beneath each outer surface 64 are a plurality of vacuum panels, such as a first or upper panel 70, a second or lower panel 72, and a middle panel 74, which is between the upper and lower panels 70 and 72. The middle panel 74 can be connected to each one of the upper and lower panels 70 and 72. The upper panel 70, the lower panel 72, and the middle panel 74 each extend parallel to the longitudinal axis A, although the upper and lower panels 70 and 72 are recessed slightly further beneath the outer surface 64 as compared to the middle panel 74. The upper and lower panels 70 and 72 are recessed equidistant beneath the outer surface 64. Of the upper panel 70, the lower panel 72, and the middle panel 74, the upper panel 70 is closest to the first end 12 and the lower panel 72 is closest to the second end 14. The upper and lower panels 70 and 72 are generally mirror images on opposite sides of the middle panel 74.

The upper panel 70 includes one or more upper panel ribs 80 and the lower panel 72 includes one or more lower panel ribs 82. The upper and lower panel ribs 80 and 82 can be configured in any suitable manner to permit the upper and lower panels 70 and 72 to flex inward in response to a vacuum, and outward in response to the container 10 being subject to increased internal pressure. Any suitable number of the upper and lower panel ribs 80 and 82 can be included, and the number of upper panel ribs 80 can be different than the number of lower panel ribs 82. For example and as illustrated, three upper panel ribs 80 and three lower panel ribs 82 are included. The upper and lower panel ribs 80 and 82 each extend into the upper and lower panels 70 and 72 respectively, such as towards the longitudinal axis A. The upper and lower panel ribs 80 and 82 extend lengthwise in a direction generally perpendicular to the longitudinal axis.

The middle panel 74 can include any suitable number of ribs as well, such as a single middle panel rib 84 as illustrated. The middle panel rib 84 extends into the middle panel 74 towards the longitudinal axis A. The middle panel rib 84 extends lengthwise in a direction generally perpendicular to the longitudinal axis A across a width of the middle panel 74. When the container 10 is under vacuum, the middle panel rib 84 acts as an initiator to allow the middle panel 74, as well as the upper and lower panels 70 and 72, to flex inward as illustrated in FIG. 3 at $F_{In}$ in order to absorb the vacuum pressure, which helps the container 10 to resist skewing and maintain its intended shape. When the container 10 is under increased internal pressure, the upper, lower, and middle panels 70, 72, and 74 can expand outward (away from the longitudinal axis A in a direction opposite to $F_{In}$) to help the container sidewalls 60A-60D resist expansion and deformation. The middle panel 74 is generally a bridge panel that is configured to act as a strap to resist expansion of the sidewalls 60A-60D when the container 10 is filled under pressure.

Each one of the first, second, third, and fourth sidewalls 60A-60D can include the panels 70, 72, and 74, as well as the ribs 80, 82, and 84, described above in the same or substantially similar configuration. The panels 70, 72, and 74, as well as the ribs 80, 82, and 84, can be scalable for different sized containers.

Each sidewall 60A-60D can further include an upper rib 90 and a lower rib 92. The upper rib 90 is recessed into the outer surface and is located between the upper panel 70 and the neck 30. The lower rib 92 is also recessed into the outer surface 64, and is between the lower panel 72 and the base 42. The upper and lower rib 90 and 92 extend lengthwise in a direction that is generally perpendicular to the longitudinal axis A. The upper and lower ribs 90 and 92 further allow the sidewalls 60A-60D to resist expansion and deformation when under pressure, and absorb vacuum forces in order to resist container skewing, thereby helping the container 10 maintain its intended shape.

The features of the container 10 can be provided at any suitable dimension, and any suitable relative dimension with respect to other features. For example and with reference to FIG. 4, the base 42 can have a maximum base width $BW_1$ that is greater than a maximum base width $BW_2$ at a ratio of 1.25:1, such that the maximum base width $BW_1$ is 0.25 times greater than the maximum base width $BW_2$. The maximum base width $BW_1$ is measured between opposing chamfered edges 62A-62D of the container 10, such as between chamfered edge 62B and chamfered edge 62D as illustrated in FIG. 4. The maximum base width $BW_2$ can be measured between opposing sidewalls 60A-60D of the container 10, such as between second sidewall 60B and fourth sidewall 60D as illustrated in FIG. 4.

With respect to the upper and lower panels 70 and 72, they can each be provided at a maximum width to maximum height ratio of 1.5:1. Thus a maximum width $W_{U/L}$ of each of the upper and lower panels 70 and 72 is 0.5 times greater than a maximum height $H_U$ and $H_L$ of each one of the upper and lower panels 70 and 72 respectively.

With respect to the middle panel 74, the middle panel 74 can be provided with a maximum width to maximum height ratio of 1.7:1. Thus a maximum width $W_M$ of the middle panel 74 is 0.7 times greater than a maximum height $H_M$ of the middle panel 74. The upper and lower panels 70 and 72 each include a maximum width $W_{U/L}$ and maximum height $H_{U/L}$ that is greater than the maximum width $W_M$ and maximum height $H_M$ of the middle panel 74.

With respect to the maximum panel area of the upper, lower, and middle panels 70, 72, and 74, each one of the upper and lower panels 70 and 72 can be provided at a ratio with respect to the middle panel 74 of 1.8:1. Thus, the maximum area of each one of the upper and lower panels 70 and 72 is 0.8 times greater than the maximum area of the middle panel 74. Accordingly, the ratio of the combined maximum area of the upper and lower panels 70 and 72 with respect to the middle panel 74 is 3.6:1. In other words, the combined maximum areas of the upper and lower panels 70 and 72 is 3.6 times greater than the maximum area of the middle panel 74. The maximum areas of the upper, lower, and middle panels 70, 72, and 74 are the maximum surface areas thereof at an exterior of the container 10 extending to an outer perimeter of the panels 70, 72, and 74, and include any radii connecting the panels 70, 72, 74 to the outer surface 64 of the body 40, as well as any ribs 80, 82, 84 that are present.

Figure 7:
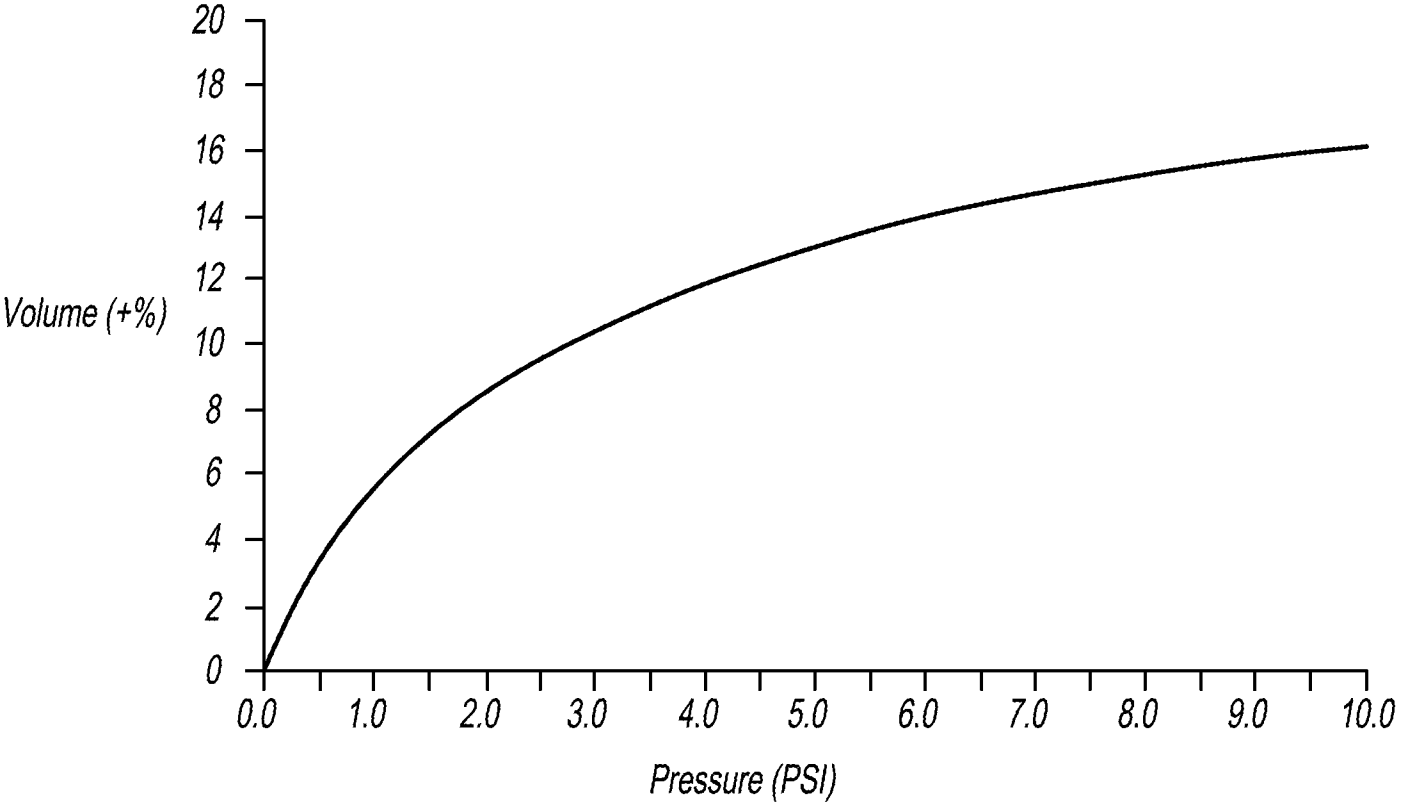
FIG. 7 is a graph showing changes in volume of the container of FIG. 1 when under different pressures.

With reference to FIG. 7, the features of the container 10 described above, such as the upper, lower, and middle panels 70, 72, and 74, provide the container 10 with enhanced pressure response properties. For example, upon being subject to an internal pressure of 2.0 PSI, the container 10 exhibits volume expansion of between 8.5% and 9.0%, such as 8.79%. At internal pressure of 5.0 PSI, the container 10 undergoes volume expansion of about 13%.

The present teachings thus advantageously provide for a container 10 that, when subject to internal vacuum pressure, the upper and lower panels 70 and 72, and particularly the middle panel 74, absorb the vacuum and resist container skewing, thereby allowing the container 10 to maintain its intended shape. The panels 70, 72, and 74 also allow the container 10 to resist expansion and deformation, such as at the sidewalls 60A-60D, when hot-filled and under pressure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure.

The terminology used is for the purpose of describing particular example embodiments only and is not intended to be limiting. The singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" includes any and all combinations of one or more of the associated listed items.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A non-round container comprising:

a sidewall including an outer surface;

a first vacuum panel recessed beneath the outer surface and including at least one first rib;

a second vacuum panel recessed beneath the outer surface and including at least one second rib; and a middle vacuum panel recessed beneath the outer surface, the middle vacuum panel connects the first vacuum panel and the second vacuum panel together, is positioned between the first and the second vacuum panels, and includes at least one middle rib;

wherein each one of the first vacuum panel and the second vacuum panel is recessed further beneath the outer surface of the sidewall than the middle vacuum panel.

2. The non-round container of claim 1, wherein the first vacuum panel and the second vacuum panel are mirror-images of each other.

3. The non-round container of claim 1, wherein the first vacuum panel and the second vacuum panel are each larger than the middle vacuum panel.

4. The non-round container of claim 1, wherein the first and second vacuum panels each have a larger height than the middle vacuum panel.

5. The non-round container of claim 1, wherein the first and second vacuum panels each have a larger width than the middle vacuum panel.

6. The non-round container of claim 1, wherein the first and the second vacuum panels each have a maximum width that is 0.5 times greater than a maximum height of each one of the first and the second vacuum panels.

7. The non-round container of claim 1, wherein the middle vacuum panel has a maximum width that is 0.7 times greater than a maximum height of the middle vacuum panel.

8. The non-round container of claim 1, wherein a maximum total combined area of the first and the second vacuum panels and a maximum total area of the middle vacuum panel are at a ratio of 3.6:1.

9. The non-round container of claim 1, wherein the container includes four sidewalls and four chamfered edges, each one of the chamfered edges connects two of the sidewalls together, a first maximum width of the container is defined between two opposing chamfered edges, and a second maximum width of the container is defined across one of the sidewalls and the chamfered edges on opposite sides thereof;

wherein the first maximum width and the second maximum width are at a ratio of 1.25:1.

10. The non-round container of claim 1, wherein when a base of the container is seated on a flat surface:

the first vacuum panel is an upper vacuum panel and the second vacuum panel is a lower vacuum panel; and the upper vacuum panel, the lower vacuum panel, and the middle vacuum panel each extend parallel to a longitudinal axis of the container.

11. The non-round container of claim 1, further comprising an upper rib between the first vacuum panel and a neck of the container, and a lower rib between the second vacuum panel and a base of the container.

12. The non-round container of claim 1, wherein the container is square or rectangular.

13. The non-round container of claim 1, wherein the middle vacuum panel includes a single rib.

14. The non-round container of claim 13, wherein the sidewall is configured to flex inward at the single rib in response to a vacuum within the container.

15. The non-round container of claim 1, wherein the first vacuum panel includes a plurality of first ribs, and the second vacuum panel includes a plurality of second ribs.

16. The non-round container of claim 1, wherein the container is configured to undergo an internal volume increase of between 8.5% and 9.0% when the container is under 2 psi of pressure.

17. The non-round container of claim 1, wherein the upper and lower vacuum panels are recessed below the sidewall at the same depth.

18. A non-round container comprising:

a plurality of sidewalls, each sidewall including:

an outer surface;

a first vacuum panel recessed beneath the outer surface and including a plurality of first ribs;

a second vacuum panel recessed beneath the outer surface and including a plurality of second ribs; and a middle vacuum panel recessed beneath the outer surface and positioned between the first and the second vacuum panels, the middle vacuum panel including a middle rib configured as an initiator to permit the first, second, and middle vacuum panels to flex inward when the non-round container is under vacuum;

wherein:

the middle vacuum panel connects both the first vacuum panel and the second vacuum panel together and is positioned between the first vacuum panel and the second vacuum panel;

the first and the second vacuum panels are both larger than the middle vacuum panel; and each one of the first vacuum panel and the second vacuum panel is recessed further beneath the outer surface of the sidewall than the middle vacuum panel.

19. The non-round container of claim 18, wherein the first vacuum panel and the second vacuum panel each have a width and a height that is greater than a middle width and a middle height of the middle vacuum panel.

20. The non-round container of claim 18, wherein the first vacuum panel is an upper vacuum panel, and the second vacuum panel is a lower vacuum panel; and wherein the upper vacuum panel is a mirror image of the lower vacuum panel.

21. The non-round container of claim 18, wherein the middle vacuum panel includes only a single rib.

22. The non-round container of claim 18, wherein each one of the first, second, and middle vacuum panels extend parallel to a longitudinal axis of the non-round of the container.

23. The non-round container of claim 18, wherein each one of the first ribs, the second ribs, and the middle rib extend in a direction perpendicular to a longitudinal axis of the non-round containers.

24. A non-round container comprising:

a plurality of sidewalls, each sidewall including:

an outer surface;

an upper vacuum panel recessed beneath the outer surface and including a plurality of upper ribs;

a lower vacuum panel recessed beneath the outer surface and including a plurality of lower ribs; and a middle vacuum panel recessed beneath the outer surface and positioned between the upper and the lower vacuum panels, the middle vacuum panel including a middle rib configured as an initiator to permit the sidewalls to flex inward when the non-round container is under vacuum, the middle vacuum panel is devoid of ribs other than the middle rib;

wherein:

the upper and the lower vacuum panels are both larger than the middle vacuum panel;

the middle vacuum panel connects both the upper vacuum panel and the lower vacuum panel together and is positioned between the upper vacuum panel and the lower vacuum panel;

each one of the upper and the lower vacuum panels are recessed further beneath the outer surface than the middle vacuum panel;

each one of the upper, lower, and middle vacuum panels have a height extending parallel to a longitudinal axis of the container; and the plurality of upper ribs, the plurality of lower ribs, and the middle rib extend in a lengthwise direction perpendicular to the longitudinal axis of the container.

25. The non-round container of claim 24, wherein the upper and the lower vacuum panels each have a maximum width that is 0.5 times greater than a maximum height of each one of the upper and the lower vacuum panels.

26. The non-round container of claim 25, wherein the middle vacuum panel has a maximum width that is 0.7 times greater than a maximum height of the middle vacuum panel.

27. The non-round container of claim 26, wherein a maximum total combined area of the upper and the lower vacuum panels and a maximum total area of the middle vacuum panel are provided at a ratio of 3.6:1.

28. The non-round container of claim 27, wherein the container includes four sidewalls and four chamfered edges, each one of the chamfered edges connects two of the sidewalls together, a first maximum width of the container is defined between two opposing chamfered edges, and a second maximum width of the container is defined across one of the sidewalls and the chamfered edges on opposite sides thereof;

wherein the first maximum width and the second maximum width are at a ratio of 1.25:1.

* * * * *